US006843333B2

(12) United States Patent
Richert et al.

(10) Patent No.: US 6,843,333 B2
(45) **Date of Patent: *Jan. 18, 2005**

(54) IMPREGNATED ROTARY DRAG BIT

(75) Inventors: Volker Richert, Celle/Gross-Hehlen (DE); Van J. Brackin, Spring, TX (US); Matthew R. Isbell, Houston, TX (US); Douglas J. Bobrosky, Alberta (CA); M. MacLean Price, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/301,359

(22) Filed: Nov. 20, 2002

(65) Prior Publication Data

US 2003/0111273 A1 Jun. 19, 2003

Related U.S. Application Data

(63) Continuation-in-part of application No. 09/709,999, filed on Nov. 10, 2000, now Pat. No. 6,510,906.
(60) Provisional application No. 60/167,781, filed on Nov. 29, 1999.

(51) Int. Cl.[7] ..... E21B 10/46
(52) U.S. Cl. ..... 175/379; 175/428; 175/434; 175/435
(58) Field of Search ..... 175/374, 375, 175/379, 398–400, 425, 428, 434, 435

(56) References Cited

U.S. PATENT DOCUMENTS

| | | | | |
|---|---|---|---|---|
| 4,109,737 A | | 8/1978 | Bovenkerk | 175/430 |
| 4,373,593 A | | 2/1983 | Phaal et al. | |
| 4,499,958 A | * | 2/1985 | Radtke et al. | 175/428 |
| 4,776,411 A | | 10/1988 | Jones | |

(List continued on next page.)

FOREIGN PATENT DOCUMENTS

| | | |
|---|---|---|
| EP | 0 418 706 A1 | 4/1987 |
| EP | 0 291 314 A3 | 11/1988 |
| EP | 0 291 314 A2 | 11/1988 |
| EP | 0 720 879 A3 | 7/1996 |
| EP | 0 720 879 A2 | 7/1996 |
| EP | 0 874 128 A2 | 10/1998 |
| FR | 2 375 428 | 5/1976 |
| FR | 2 504 589 | 10/1982 |
| GB | 2 347 957 A | 9/2000 |
| GB | 2 353 053 A | 2/2001 |
| GB | 2 353 548 A | 2/2001 |
| WO | WO 97/48877 | 12/1997 |
| WO | WO 98/27311 | 6/1998 |
| WO | WO 99/36658 A1 | 7/1999 |

OTHER PUBLICATIONS

UK Patent Office, Combined Search and Examination Report under Sections 17 & 18(3), dated May 7, 2004.

(List continued on next page.)

*Primary Examiner*—Zakiya Walker
(74) *Attorney, Agent, or Firm*—TraskBritt

(57) ABSTRACT

A drill bit employing a plurality of discrete, post-like, abrasive, particulate-impregnated cutting structures extending upwardly from abrasive, particulate-impregnated blades defining a plurality of fluid passages therebetween on the bit face. Additional cutting elements may be placed in the cone of the bit surrounding the centerline thereof. The blades may extend radially in a linear fashion, or be curved and spiral outwardly to the gage to provide increased blade length and enhanced cutting structure redundancy. Additionally, discrete protrusions may extend outwardly from at least some of the plurality of cutting structures. The discrete protrusions may be formed of a thermally stable diamond product and may exhibit a generally triangular cross-sectional geometry relative to the direction of intended bit rotation.

37 Claims, 7 Drawing Sheets

U.S. PATENT DOCUMENTS

| | | | | | |
|---|---|---|---|---|---|
| 4,794,994 | A | | 1/1989 | Deane et al. | |
| 4,813,500 | A | | 3/1989 | Jones | |
| 4,823,892 | A | | 4/1989 | Fuller | |
| 4,848,489 | A | | 7/1989 | Deane | |
| 4,889,017 | A | | 12/1989 | Fuller et al. | |
| 4,907,662 | A | | 3/1990 | Deane et al. | |
| 4,913,247 | A | * | 4/1990 | Jones | 175/434 |
| 4,943,488 | A | | 7/1990 | Sung et al. | |
| 4,991,670 | A | | 2/1991 | Fuller et al. | |
| 5,033,559 | A | | 7/1991 | Fischer | |
| 5,049,164 | A | | 9/1991 | Horton et al. | |
| 5,303,785 | A | * | 4/1994 | Duke | 175/57 |
| 5,582,261 | A | | 12/1996 | Keith et al. | |
| 5,722,499 | A | | 3/1998 | Nguyen et al. | |
| 5,732,784 | A | | 3/1998 | Nelson | |
| 6,003,623 | A | | 12/1999 | Miess | |
| 6,009,962 | A | | 1/2000 | Beaton | |
| 6,021,858 | A | | 2/2000 | Southland | |
| 6,062,325 | A | | 5/2000 | Taylor et al. | |
| 6,095,265 | A | | 8/2000 | Alsup | |
| 6,142,250 | A | | 11/2000 | Griffin et al. | |
| 6,216,805 | B1 | | 4/2001 | Lays et al. | |
| 6,241,036 | B1 | | 6/2001 | Lovato et al. | |
| 6,296,069 | B1 | | 10/2001 | Lamine et al. | |
| 6,401,844 | B1 | | 6/2002 | Doster et al. | |
| 6,458,471 | B2 | | 10/2002 | Lovato et al. | |
| 6,510,906 | B1 | * | 1/2003 | Richert et al. | 175/39 |

OTHER PUBLICATIONS

Search Report from the UK Patent Office, dated Jan. 19, 2004.

UK Examination Report, dated Apr. 29, 2003.

Search Report of Feb. 27, 2001.

Belgian Search Report of Jul. 19, 2002.

* cited by examiner

IMPREGNATED ROTARY DRAG BIT

CROSS-REFERENCE TO RELATED APPLICATIONS

Related Applications: This application is a continuation-in-part of U.S. application Ser. No. 09/709,999, filed Nov. 10, 2000, and entitled IMPREGNATED BIT WITH PDC CUTTERS IN CONE AREA, now U.S. Pat. No. 6,510,906, issued Jan. 28, 2003, which claims the benefit of U.S. Provisional Patent Application Ser. No. 60/167,781, filed Nov. 29, 1999.

BACKGROUND OF THE INVENTION

1. Field of the Invention

The present invention relates generally to fixed cutter or drag-type bits for drilling subterranean formations and, more specifically, to drag bits for drilling hard and/or abrasive rock formations, and especially for drilling such formations interbedded with soft and nonabrasive layers.

2. State of the Art

So-called "impregnated" drag bits are used conventionally for drilling hard and/or abrasive rock formations, such as sandstones. The impregnated drill bits typically employ a cutting face composed of superabrasive cutting particles, such as natural or synthetic diamond grit, dispersed within a matrix of wear-resistant material. As such a bit drills, the matrix and embedded diamond particles wear, worn cutting particles are lost and new cutting particles are exposed. These diamond particles may either be natural or synthetic and may be cast integral with the body of the bit, as in low-pressure infiltration, or may be preformed separately, as in hot isostatic pressure infiltration, and attached to the bit by brazing or furnaced to the bit body during manufacturing thereof by an infiltration process.

Conventional impregnated bits generally exhibit a poor hydraulics design by employing a crow's foot to distribute drilling fluid across the bit face and providing only minimal flow area. Further, conventional impregnated bits do not drill effectively when the bit encounters softer and less abrasive layers of rock, such as shales. When drilling through shale, or other soft formations, with a conventional impregnated drag bit, the cutting structure tends to quickly clog or "ball up" with formation material, making the drill bit ineffective. The softer formations can also plug up fluid courses formed in the drill bit, causing heat buildup and premature wear of the bit. Therefore, when shale-type formations are encountered, a more aggressive bit is desired to achieve a higher rate of penetration (ROP). It follows, therefore, that selection of a bit for use in a particular drilling operation becomes more complicated when it is expected that formations of more than one type will be encountered during the drilling operation.

Moreover, during the drilling of a well bore, the well may be drilled in multiple sections wherein at least one section is drilled followed by the cementing of a tubular metal casing within the borehole. In some instances, several sections of the well bore may include casing of successively smaller sizes, or a liner may be set in addition to the casing. In cementing the casing (such term including a liner) within the borehole, cement is conventionally disposed within an annulus defined between the casing and the borehole wall by flowing the cement downwardly through the casing to the bottom thereof and then displacing the cement through a so-called "float shoe" such that it flows back upwardly through the annulus. Such a process conventionally results in a mass or section of hardened cement proximate the float shoe and formed at the lower extremity of the casing. Thus, in order to drill the well bore to further depths, it becomes necessary to first drill through the float shoe and mass of cement.

Conventionally, the drill bit used to drill out the cement and float shoe does not exhibit the desired design for drilling the subterranean formation which lies there beyond. Thus, those drilling the well bore are often faced with the decision of changing out drill bits after the cement and float shoe have been penetrated or, alternatively, continuing with a drill bit which may not be optimized for drilling the subterranean formation below the casing.

Thus, it would be beneficial to design a drill bit which would perform more aggressively in softer, less abrasive formations while also providing adequate ROP in harder, more abrasive formations without requiring increased weight on bit (WOB) during the drilling process.

Additionally, it would be advantageous to provide a drill bit with "drill out" features which enable the drill bit to drill through a cement shoe and continue drilling the subsequently encountered subterranean formation in an efficient manner.

BRIEF SUMMARY OF THE INVENTION

The present invention comprises a rotary drag bit employing impregnated cutting elements in the form of discrete, post-like, mutually separated cutting structures projecting upwardly from generally radially extending blades on the bit face, the blades defining fluid passages therebetween extending to junk slots on the bit gage. The cone portion, or central area of the bit face, is of a relatively shallow configuration and may be provided with cutting elements such as, for example, superabrasive cutters in the form of polycrystalline diamond compacts (PDCs). Such cutting elements may provide superior performance in interbedded and shaley formations. Bit hydraulics are enhanced by the aforementioned fluid passages, which are provided with drilling fluid by a plurality of nozzles located in ports distributed over the bit face for enhanced volume and apportionment of drilling fluid flow.

In one embodiment, the blades extend generally radially outwardly in a linear fashion from locations within the cone at the centerline of the bit (in the case of blades carrying the PDC cutters in the cone), within the cone but not at the centerline, or at the edge of the cone, to the gage of the bit, where contiguous gage pads extend longitudinally and define junk slots therebetween. In another embodiment, the blades are curved and extend generally radially outwardly in a spiral fashion from the centerline (again, in the case of the blades carrying PDC cutters), within the cone, or at the edge of the cone, to the gage of the bit and contiguous with longitudinally extending gage pads defining junk slots therebetween. The elongated nature of the spiraled blades provides additional length for carrying the discrete cutting structures so as to enhance redundancy thereof at any given radius.

In another embodiment, generally discrete protrusions may extend from the outer ends of the discrete, mutually separated cutting structures. The discrete protrusions may be formed of a material comprising, for example, thermally stable diamond products (TSP) and may exhibit a generally triangular cross-sectional geometry taken in a direction which is normal to the intended direction of bit rotation. Such discrete protrusions enable the bit to drill through features such as a cement shoe at the bottom of a well bore casing.

DETAILED DESCRIPTION OF THE INVENTION

Figure 1:
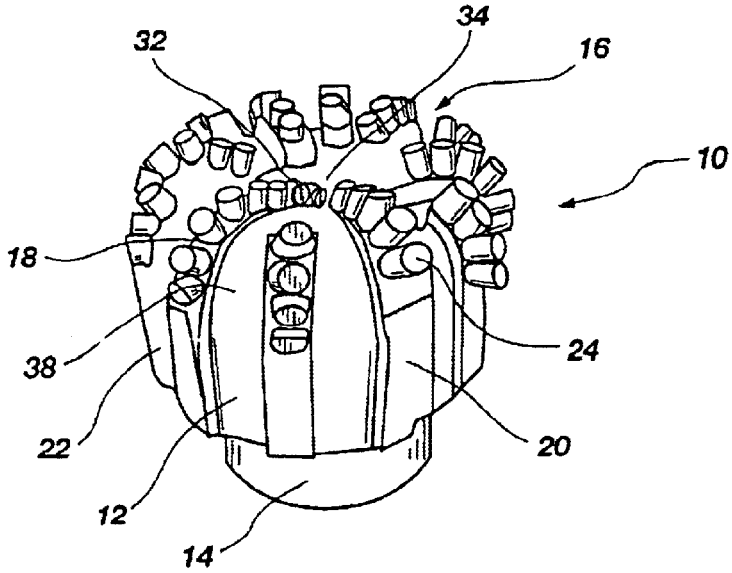
FIG. 1 comprises an inverted perspective view of a first embodiment of a bit of the present invention.
Figure 2A:
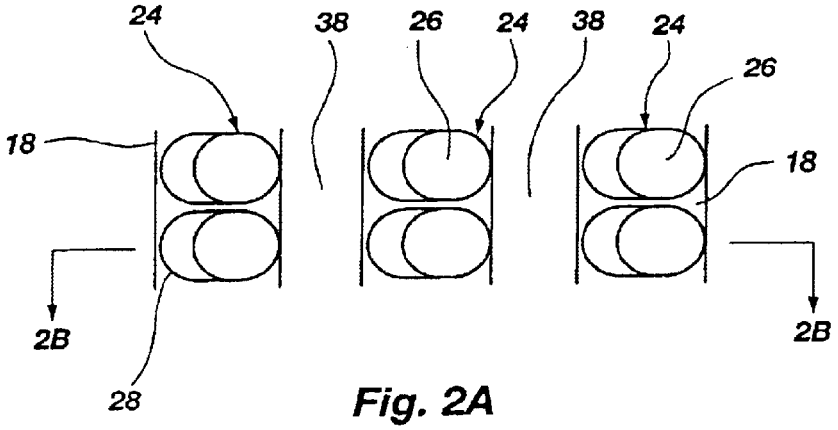
FIG. 2A is a schematic top elevation of portions of a plurality of blades of the bit of FIG. 1 carrying discrete cutting structures and FIG. 2B is a side sectional elevation taken across line 2B—2B of FIG. 2A.
Figure 2B:
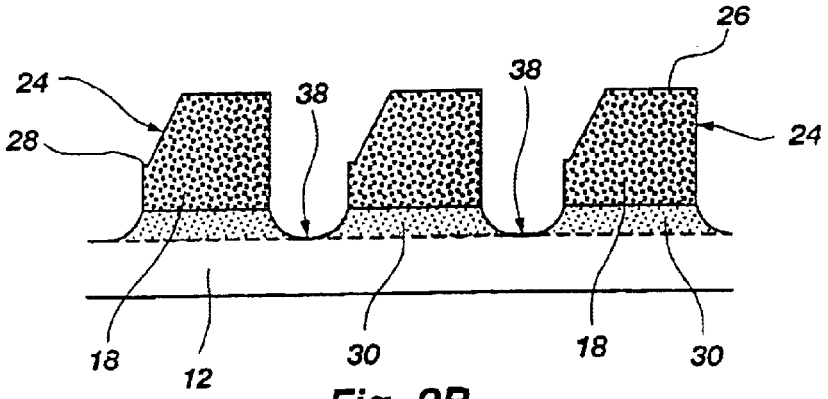
Figure 3:
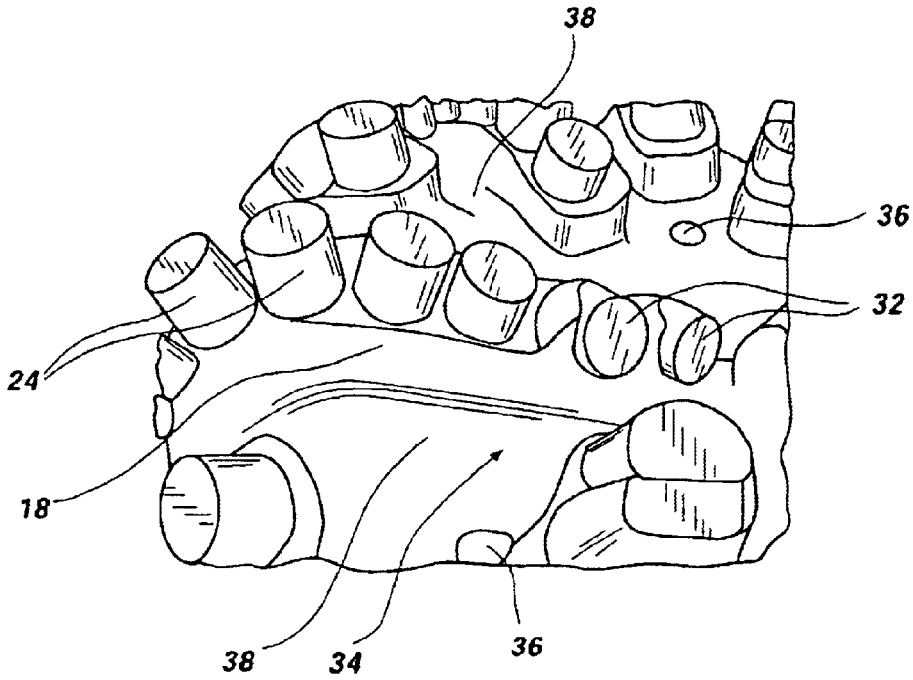
FIG. 3 is an enlarged, inverted perspective view of part of the cone portion of the face of the bit of FIG. 1, showing wear of discrete, diamond grit-impregnated cutting structures and PDC cutters.

Referring now to FIGS. 1–3 of the drawings, a first embodiment of the bit 10 of the present invention is depicted in perspective, bit 10 being inverted from its normal face-down operating orientation for clarity. Bit 10 is, by way of example only, of 8½" diameter and includes a matrix-type bit body 12 having a shank 14 for connection to a drill string (not shown) extending therefrom opposite bit face 16. A plurality of (in this instance, twelve (12)) blades 18 extends generally radially outwardly in linear fashion to gage pads 20 defining junk slots 22 therebetween.

Unlike conventional impregnated bit cutting structures, the discrete, impregnated cutting structures 24 comprise posts extending upwardly (as shown in FIG. 1) on blades 18 from the bit face 16. The cutting structures are formed as an integral part of the matrix-type blades 18 projecting from a matrix-type bit body 12 by hand-packing diamond grit-impregnated matrix material in mold cavities on the interior of the bit mold defining the locations of the cutting structures 24 and blades 18 and, thus, each blade 18 and associated cutting structure 24 defines a unitary structure. It is noted that the cutting structures 24 may be placed directly on the bit face 16, dispensing with the blades. However, as discussed in more detail below, it is preferable to have the cutting structures 24 located on the blades 18. It is also noted that, while discussed in terms of being integrally formed with the bit 10, the cutting structures 24 may be formed as discrete individual segments, such as by hot isostatic pressing, and subsequently brazed or furnaced onto the bit 10.

Discrete cutting structures 24 are mutually separate from each other to promote drilling fluid flow therearound for enhanced cooling and clearing of formation material removed by the diamond grit. Discrete cutting structures 24, as shown in FIG. 1, are generally of a round or circular transverse cross-section at their substantially flat, outermost ends 26, but become more oval with decreasing distance from the face of the blades 18 and thus provide wider or more elongated (in the direction of bit rotation) bases 28 (see FIGS. 2A and 2B) for greater strength and durability. As the discrete cutting structures 24 wear (see FIG. 3), the exposed cross-section of the posts increases, providing progressively increasing contact area for the diamond grit with the formation material. As the cutting structures wear down, the bit 10 takes on the configuration of a heavier-set bit more adept at penetrating harder, more abrasive formations. Even if discrete cutting structures 24 wear completely away, the diamond-impregnated blades 18 will provide some cutting action, reducing any possibility of ring-out and having to pull the bit 10.

While the cutting structures 24 are illustrated as exhibiting posts of circular outer ends and oval shaped bases, other geometries are also contemplated. For example, the outermost ends 26 of the cutting structures may be configured as ovals having a major diameter and a minor diameter. The base portion adjacent the blade 18 might also be oval, having a major and a minor diameter, wherein the base has a larger minor diameter than the outermost end 26 of the cutting structure 24. As the cutting structure 24 wears towards the blade 18, the minor diameter increases, resulting in a larger surface area. Furthermore, the ends of the cutting structures 24 need not be flat, but may employ sloped geometries. In other words, the cutting structures 24 may change cross-sections at multiple intervals, and tip geometry may be separate from the general cross-section of the cutting structure. Other shapes or geometries may be configured similarly. It is also noted that the spacing between individual cutting structures 24, as well as the magnitude of the taper from the outermost ends 26 to the blades 18, may be varied to change the overall aggressiveness of the bit 10 or to change the rate at which the bit is transformed from a light-set bit to a heavy-set bit during operation. It is further contemplated that one or more of such cutting structures 24 may be formed to have substantially constant cross-sections if so desired depending on the anticipated application of the bit 10.

Discrete cutting structures 24 may comprise a synthetic diamond grit, such as, for example, DSN-47 Synthetic diamond grit, commercially available from DeBeers of Shannon, Ireland, which has demonstrated toughness superior to natural diamond grit. The tungsten carbide matrix material with which the diamond grit is mixed to form discrete cutting structures 24 and supporting blades 18 may desirably include a fine grain carbide, such as, for example, DM2001 powder commercially available from Kennametal Inc., of Latrobe, Pa. Such a carbide powder, when infiltrated, provides increased exposure of the diamond grit particles in comparison to conventional matrix materials due to its relatively soft, abradable nature. The base 30 of each blade 18 may desirably be formed of, for example, a more durable 121 matrix material, obtained from Firth MPD of Houston, Tex. Use of the more durable material in this region helps to prevent ring-out even if all of the discrete cutting structures 24 are abraded away and the majority of each blade 18 is worm.

It is noted, however, that alternative particulate abrasive materials may be suitably substituted for those discussed above. For example, the discrete cutting structures 24 may include natural diamond grit, or a combination of synthetic and natural diamond grit. Alternatively, the cutting structures may include synthetic diamond pins. Additionally, the particulate abrasive material may be coated with a single layer or multiple layers of a refractory material, as known in the art and disclosed in U.S. Pat. Nos. 4,943,488 and 5,049,164, the disclosures of each of which are hereby incorporated herein by reference in their entirety. Such refractory materials may include, for example, a refractory metal, a refractory metal carbide or a refractory metal oxide. In one embodiment, the coating may exhibit a thickness of approximately 1 to 10 microns. In another embodiment, the coating may exhibit a thickness of approximately 2 to 6 microns. In yet another embodiment, the coating may exhibit a thickness of less than 1 micron.

Figure 4:
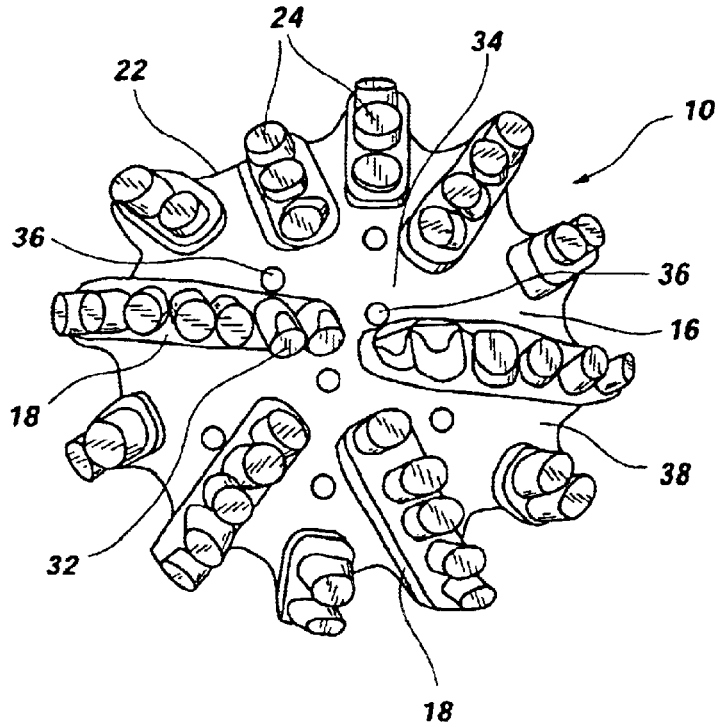
FIG. 4 is a top elevation of the bit of FIG. 1 after testing, showing wear of the discrete cutting structures and PDC cutters.

Referring now to FIG. 4, the radially innermost ends of two blades 18 extend to the centerline of bit 10 and carry cutting elements, shown as PDC cutters 32, in conventional orientations, with cutting faces oriented generally facing the direction of bit rotation. PDC cutters 32 are located within the cone portion 34 of the bit face 16. The cone portion 34, best viewed with reference to FIG. 1, is the portion of the bit face 16 wherein the profile is defined as a generally cone-shaped section about the centerline of intended rotation of the drill bit 10. While both discrete cutting structures 24 and PDC cutters 32 are carried by the bit, as is apparent in FIGS. 1 and 4, there is desirably a greater quantity of the discrete cutting structures 24 than there are PDC cutters 32.

The PDC cutters may comprise cutters having a PDC jacket or sheath extending contiguously with, and to the rear of, the PDC cutting face and over the supporting substrate. For example, a cutter of this type is offered by Hughes Christensen Company, a wholly owned subsidiary of the assignee of the present invention, as NIAGARA™ cutters. Such cutters are further described in U.S. Pat. No. 6,401,844, issued Jun. 11, 2002, and entitled CUTTER WITH COMPLEX SUPERABRASIVE GEOMETRY AND DRILL BITS SO EQUIPPED. This cutter design provides enhanced abrasion resistance to the hard and/or abrasive formations typically drilled by impregnated bits, in combination with enhanced performance (ROP) in softer, non-abrasive formation layers interbedded with such hard formations. It is noted, however, that alternative PDC cutter designs may be implemented. Rather, PDC cutters 32 may be configured of various shapes, sizes, or materials as known by those of skill in the art. Also, other types of cutting elements may be formed within the cone portion 34 of the bit depending on the anticipated application of the bit 10. For example, the cutting elements formed within the cone portion 34 may include cutters formed of thermally stable diamond product (TSP), natural diamond material, or impregnated diamond.

Again referring to FIG. 4 of the drawings, bit 10 employs a plurality (for example, eight (8)) ports 36 over the bit face 16 to enhance fluid velocity of drilling fluid flow and better apportion the flow over the bit face 16 and among fluid passages 38 between blades 18 and extending to junk slots 22. This enhanced fluid velocity and apportionment helps prevent bit balling in shale formations, for example, which phenomenon is known to significantly retard ROP. Further, in combination with the enhanced diamond exposure of bit 10, the improved hydraulics substantially enhances drilling through permeable sandstones.

Still referring to FIG. 4, an example of employing a conventional impregnated bit gage design in accordance with the present invention is disclosed. By way of illustration only, the gage pads of the illustrated embodiment may be approximately 3 inches long, each comprising approximately 1.5 inches of thermally stable product (TSP) diamond and diamond grit-impregnated matrix, and approximately 1.5 inches of carbide bricks and K-type natural diamonds. Such an arrangement may likewise be applied to bits of differing diameters.

In operation, bit 10 according to the present invention would be run into a well and "broken-in" or "sharpened" by drilling into an abrasive formation at a selected WOB as the bit is rotated. For the first several feet of penetration, the diamond grit on the ends of the posts forming discrete cutting structures 24 becomes more exposed, as no substantial volume of diamond is usually exposed on an impregnated bit as manufactured. Once the bit has been "sharpened" to expose the diamond grit at the outermost ends 26 of discrete cutting structures 24, ROP stabilizes. It has been demonstrated in testing on a full-scale laboratory drilling simulator that the inventive bit may exhibit an increased ROP over conventional impregnated bits. It has likewise been shown that the inventive bit may exhibit a substantially similar ROP to that of a conventional impregnated bit but at a reduced WOB.

Figure 5:
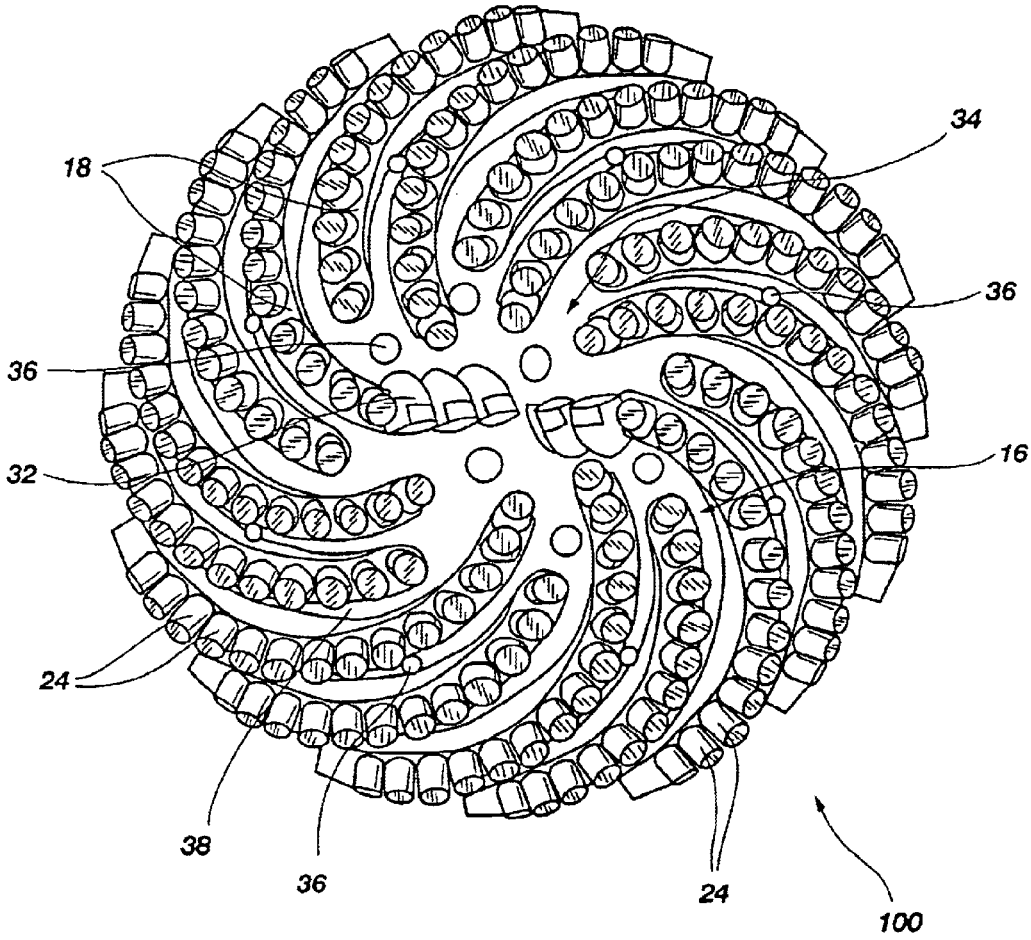
FIG. 5 is a top elevation of a second embodiment of the bit of the present invention.
Figure 6:
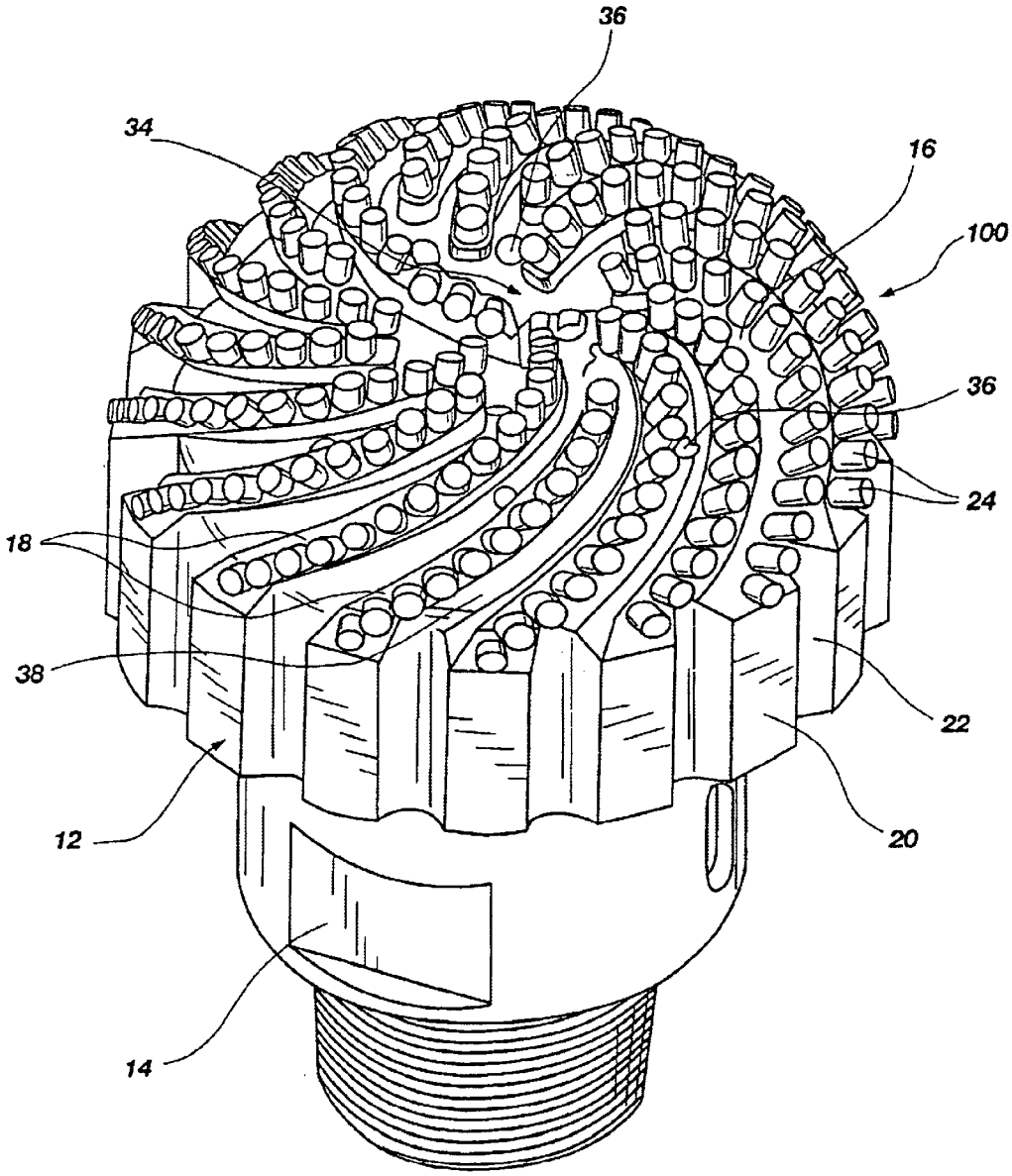
FIG. 6 is an inverted perspective view of the bit of FIG. 5.

Referring now to FIGS. 5 and 6 of the drawings, another embodiment 100 of the bit according to the invention is depicted. Features previously described with reference to bit 10 are identified with the same reference numerals on bit 100. It will be noted that there is a larger number of blades 18 on bit 100 than on bit 10, and that the blades 18 spiral outwardly from the cone portion 34 of bit 100 toward the gage pads 20. The use of the curved, spiraled blades 18 provides increased blade length and thus greater redundancy of coverage of discrete cutting structures 24 at each radius. It should also be noted that there are a larger number of ports 36 on bit face 16 for fluid distribution typically through nozzles (not shown) installed in the ports 36. The ports 36 within the cone portion 34 are preferably of larger diameter than those outside of the cone portion 34. Alternatively, the blades 18 may be formed in other shapes or patterns. For example, the blades may be formed to extend outwardly from the cone portion 34 in a serpentine fashion, each blade forming an "S" shape as it travels across the bit face 16 toward the gage pads 20.

Figure 7:
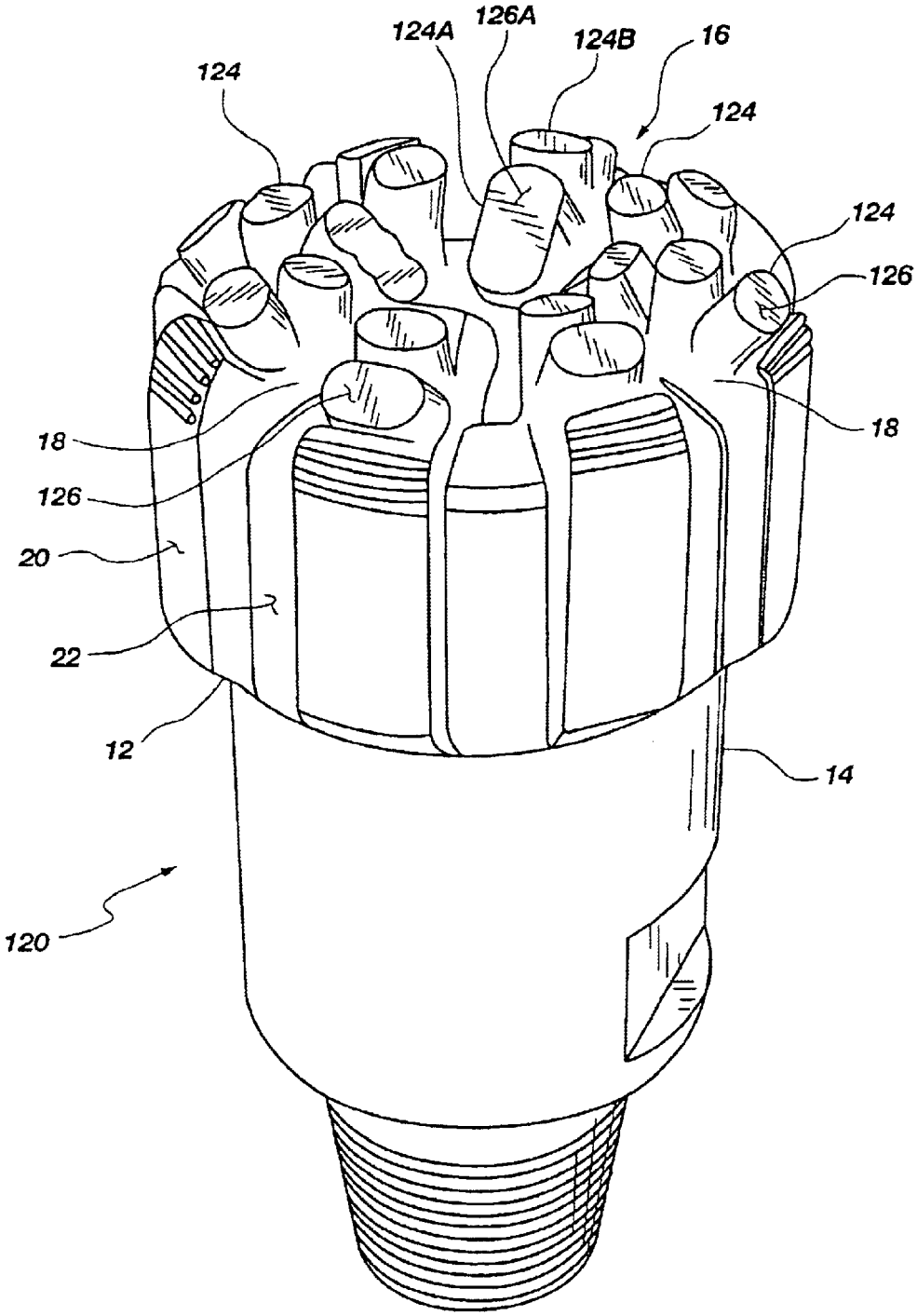
FIG. 7 is an inverted perspective view of a bit according to another embodiment of the present invention.

Referring now to FIG. 7, a bit 120 is shown in accordance with another embodiment of the present invention. As with the embodiments described above, the bit 120 includes a matrix-type bit body 12 having a shank 14, for connection with a drill string, extending therefrom opposite a bit face 16. The bit 120 also includes a plurality of blades 18 extending generally radially outwardly to gage pads 20 which define junk slots 22 therebetween.

Cutting structures 124 comprising posts extend upwardly from the blades 18 and are formed as described hereinabove. The cutting structures 124, as shown in FIG. 7, exhibit generally flat, oval cross-sectional geometries which are substantially constant from their outer ends 126 down to where they interface with the blades 18. It is noted, however, that the cutting structures 124 may exhibit other cross-sectional geometries, including those which change from their outer ends 126 to where they interface with the blades 18, as previously described herein.

The bit 120 does not necessarily include additional cutters, such as PDC cutters, in the cone portion 34 of the bit face 16. Rather, the cone portion 34 may include additional cutting structures 124A therein. The cutting structures 124A located within the cone portion 34 may exhibit geometries which are similar to those which are more radially disposed on the bit face 16, or they may exhibit geometries which are different from those which are more radially disposed on the bit face. For example, cutting structure 124A, as shown in FIG. 7, while exhibiting a generally flat, oval outer end 126A, exhibits dimensions which are different from those more radially outwardly disposed such that the major and minor axes of the generally oval geometry are rotated approximately 90° relative to the cutting structure 124B adjacent thereto.

Figure 8:
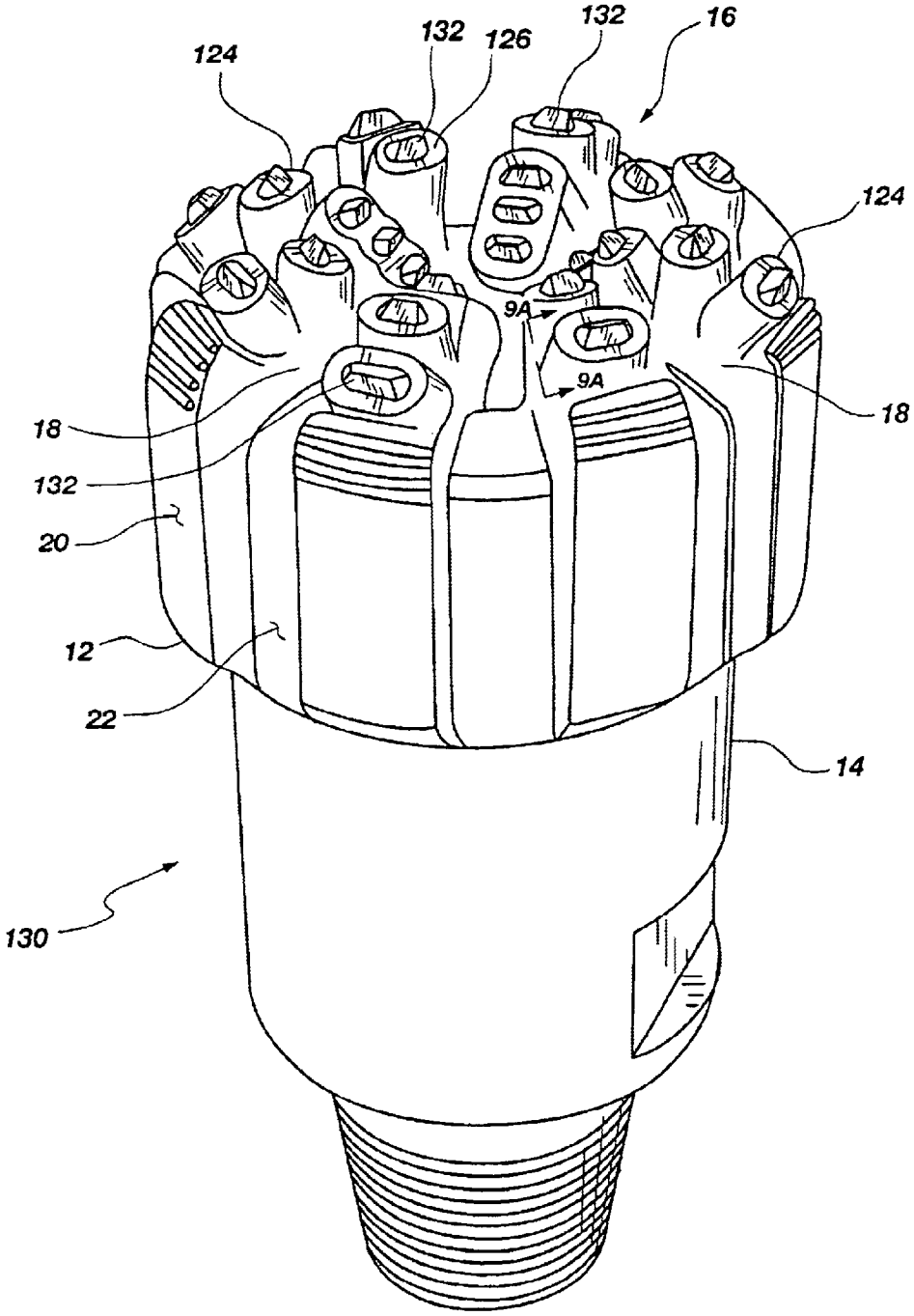
FIG. 8 is an inverted perspective view of a bit according to yet another embodiment of the present invention.

Referring now to FIG. 8, a drill bit 130 is shown according to yet another embodiment of the present invention. The drill bit 130 is configured generally similar to that which is described with respect to FIG. 7, but includes what may be termed "drill out" features which enable the bit 130 to drill through, for example, a float shoe and mass of cement at the bottom of a casing within a well bore.

Figure 9A:
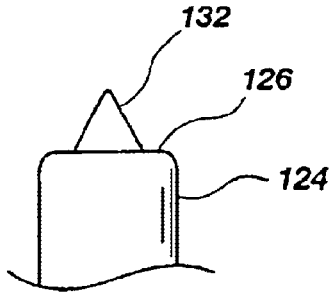
FIG. 9A is an elevational side view of a cutting structure and associated discrete protrusion as indicated by section line 9A—9A in FIG. 8.

Discrete protrusions 132, formed of, for example, a TSP material, extend from a central portion of the generally flat outer end 126 of some or all of the cutting structures 124. As shown in FIG. 9A, the discrete protrusions 132 may exhibit a substantially triangular cross-sectional geometry having a generally sharp outermost end, as taken normal to the intended direction of bit rotation, with the base of the triangle embedded in the cutting structure 124 and being mechanically and metallurgically bonded thereto. The TSP material may be coated with, for example, a refractory material such as that described hereinabove.

Figure 9B:
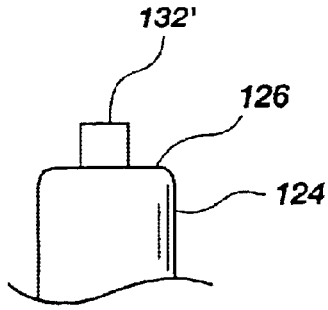
FIG. 9B is an elevational side view of a cutting structure and associated discrete protrusion according to another embodiment of the present invention.
Figure 9C:
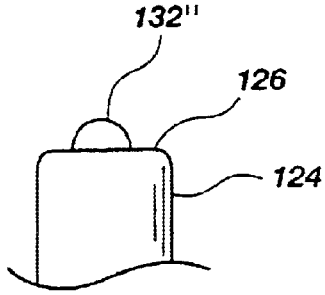
FIG. 9C is an elevational side view of a cutting structure and associated discrete protrusion according to yet another embodiment of the present invention.

The discrete protrusions 132 may exhibit other geometries as well. For example, FIG. 9B shows a discrete protrusion 132' having a generally square or rectangular cross-sectional geometry as taken normal to the intended direction of bit rotation and, thus, exhibits a generally flat outermost end. Another example is shown in FIG. 9C wherein the discrete protrusion 132" exhibits a generally rounded or semicircular cross-sectional area as taken normal to the intended direction of bit rotation.

As shown in FIG. 8, the cross-sectional geometry of each of the discrete protrusions 132, taken substantially parallel with the generally flat outer end 126 of its associated cutting structure 124, is generally congruous with the cross-sectional geometry of the cutting structure 124. It is noted that a portion of each of the cutting structure's outer end 126 surrounding the discrete protrusions 132 remains exposed. Thus, the discrete protrusions 132 do not completely conceal, or otherwise replace, the generally flat outer ends 126 of the cutting structures 124. Rather, discrete protrusions 132 augment the cutting structures 124 for the penetration of, for example, a float shoe and associated mass of cement therebelow or similar structure prior to penetrating the underlying subterranean formation.

While the bits of the present invention have been described with reference to certain exemplary embodiments, those of ordinary skill in the art will recognize and appreciate that is not so limited. Additions, deletions and modifications to the embodiments illustrated and described herein may be made without departing from the scope of the invention as defined by the claims herein. Similarly, features from one embodiment may be combined with those of another.

What is claimed is:

1. A rotary drag bit for drilling subterranean formations, comprising:

a bit body having a face extending from a centerline to a gage;

a plurality of blades comprising a particulate abrasive material on the face and extending generally radially outwardly toward the gage;

a plurality of discrete, mutually separated cutting structures comprising a particulate abrasive material protruding upwardly from each of the blades; and a plurality of discrete protrusions, wherein each discrete protrusion of the plurality extends outwardly from an associated one of the plurality of cutting structures.

2. The rotary drag bit of claim 1, wherein the discrete cutting structures and the blades comprises unitary structures.

3. The rotary drag bit of claim 1, wherein the particulate abrasive material comprises at least one of synthetic diamond grit and natural diamond grit.

4. The rotary drag bit of claim 1, wherein the particulate abrasive material comprises a coating including a refractory material.

5. The rotary drag bit of claim 4, wherein the refractory material comprises at least one of a refractory metal, a refractory metal carbide and a refractory metal oxide.

6. The rotary drag bit of claim 5, wherein the coating exhibits a thickness of approximately 1 to 10 microns.

7. The rotary drag bit of claim 5, wherein the coating exhibits a thickness of approximately 2 to 6 microns.

8. The rotary drag bit of claim 5, wherein the coating exhibits a thickness of less than approximately 1 micron.

9. The rotary drag bit of claim 1, wherein each discrete protrusion of the plurality exhibits a substantially triangular cross-sectional relative to a direction of intended bit rotation.

10. The rotary drag bit of claim 9, wherein the plurality of discrete protrusions is formed of a material comprising thermally stable diamond product (TSP).

11. The rotary drag bit of claim 9, wherein each of the plurality of discrete protrusions is located at a central portion of a generally flat outer end of the associated one of the plurality of cutting structures.

12. A rotary drag bit for drilling subterranean formations, comprising:

a bit body having a face extending from a centerline to a gage:

a plurality of blades comprising a particulate abrasive material on the face and extending generally radially outwardly toward the gage; and a plurality of discrete, mutually separated cutting structures comprising a particulate abrasive material protruding upwardly from each of the blades, wherein the discrete cutting structures are configured as posts having substantially flat outer ends.

13. The rotary drag bit of claim 12, wherein the posts include bases of larger cross-sectional area than outermost ends thereof.

14. The rotary drag bit of claim 13, wherein the posts taper from substantially circular outermost ends to substantially oval bases.

15. The rotary drag bit of claim 12, wherein the posts exhibit a substantially constant cross-sectional area taken in a plane substantially parallel to the substantially flat outer ends.

16. The rotary drag bit of claim 12, wherein the face includes a cone portion surrounding the centerline and wherein at least one cutting element is disposed on the face of the bit body within the cone portion.

17. The rotary drag bit of claim 16, wherein the at least one cutting element comprises at least one of a polycrystalline diamond compact (PDC) cutting element, a thermally stable diamond product (TSP), a material comprising natural diamonds, and diamond-impregnated material.

18. The rotary drag bit of claim 16, wherein at least one blade of the plurality of blades extends to a location proximate the centerline, and the at least one cutting element is carried by the at least one blade.

19. A rotary drag bit for drilling subterranean formations, comprising:

a bit body having a face extending from a centerline to a gage; plurality of blades comprising a particulate abrasive material on the face and extending generally radially outwardly toward the gage; and a plurality of discrete, mutually separated cutting structures comprising a particulate abrasive material protruding upwardly from each of the blades, wherein the bit body comprises a matrix-type bit body, and the blades are integral with the bit body.

20. The rotary drag bit of claim 19, wherein the discrete cutting structures are integral with the blades and the bit body.

21. The rotary drag bit of claim 20, wherein the discrete cutting structures and the plurality of blades comprise a metal matrix material carrying a diamond grit material and wherein the discrete cutting structures and at least a portion of the blades are comprised of a softer and more abradable metal matrix material than that of the metal matrix material present in bases of the blades.

22. A rotary drag bit for drilling subterranean formations, comprising:

a bit body having a face extending from a centerline to a gage, the face including a cone portion surrounding the centerline;

a plurality of cutting structures located on the face external of the cone portion, the plurality of cutting structures consisting essentially of a plurality of discrete, mutually separated posts comprising a particulate abrasive material protruding upwardly from the face, wherein the posts and the bit body face comprise a unitary structure.

23. The rotary drag bit of claim 22, wherein the particulate abrasive material comprises at least one of synthetic diamond grit and natural diamond grit.

24. The rotary drag bit of claim 22, wherein the bit body comprises a matrix-type bit body.

25. The rotary drag bit of claim 22, further comprising at least one cutting element disposed within the cone portion.

26. The rotary drag bit of claim 25, wherein the at least one cutting element comprises at least one of a polycrystalline diamond compact (PDC) cutting element, a thermally stable diamond product (TSP) (TSP), a material comprising natural diamonds, and a diamond-impregnated material.

27. The rotary drag bit of claim 22, wherein the particulate abrasive material comprises a coating including a refractory material.

28. The rotary drag bit of claim 27, wherein the refractory material comprises at least one of a refractory metal, a refractory metal carbide and a refractory metal oxide.

29. The rotary drag bit of claim 28, wherein the coating exhibits a thickness of approximately 1 to 10 microns.

30. The rotary drag bit of claim 28, wherein the coating exhibits a thickness of approximately 2 to 6 microns.

31. The rotary drag bit of claim 28, wherein the coating exhibits a thickness than approximately 1 micron.

32. A rotary drag bit for drilling subterranean formations, comprising:

a bit body having a face extending from a centerline to a gage, the face including a cone portion surrounding the centerline:

a plurality of cutting structures located on the face external of the cone portion, the plurality of cutting structures consisting essentially of a plurality of discrete, mutually separated posts comprising a particulate abrasive material protruding upwardly from the face, and a plurality of blades on the face extending generally radially outwardly toward the gage, each blade having at least one of the plurality of posts positioned thereon, wherein the posts and the blades comprise unitary structures.

33. The rotary drag bit of claim 32, wherein the blades are formed of a particulate abrasive material.

34. A rotary drag bit for drilling subterranean formations, comprising:

a bit body having a face extending from a centerline to a gage, the face including a cone portion surrounding the centerline, a plurality of cutting structures located on the face external of the cone portion, the plurality of cutting structures consisting essentially of a plurality of discrete, mutually separated posts comprising a particulate abrasive material protruding upwardly from the face, and a plurality of discrete protrusions, wherein each discrete protrusion extends outwardly from an associated one of the plurality of cutting structures.

35. The rotary drag bit of claim 34, wherein each discrete protrusion of the plurality exhibits at least one of a substantially triangular cross-sectional geometry, a substantially square cross-sectional geometry and a substantially semicircular cross-sectional geometry relative to a direction of intended bit rotation.

36. The rotary drag bit of claim 34, wherein the plurality of discrete protrusions is formed of a material comprising thermally stable diamond product (TSP).

37. The rotary drag bit of claim 34, wherein each of the plurality of discrete protrusions is located at a central portion of a generally flat outer end of the associated one of the plurality of cutting structures.

* * * * *

UNITED STATES PATENT AND TRADEMARK OFFICE

CERTIFICATE OF CORRECTION

PATENT NO. : 6,843,333 B2
APPLICATION NO. : 10/301359
DATED : January 18, 2005
INVENTOR(S) : Volker Richert et al.

It is certified that error appears in the above-identified patent and that said Letters Patent is hereby corrected as shown below:

In the specification:

| | | |
|---|---|---|
| COLUMN 4, | LINE 65, | change “worm” to --worn-- |
| COLUMN 7, | LINE 55, | after “that” and before “is” insert --it-- |

In the claims:

| | | | |
|---|---|---|---|
| CLAIM 19, | COLUMN 9, | LINE 6, | before “plurality” insert --a-- |
| CLAIM 26, | COLUMN 9, | LINE 47 | delete the second occurrence of “[(TSP)]” |
| CLAIM 31, | COLUMN 10, | LINE 6, | after “thickness” and before “than” insert --of less-- |

Signed and Sealed this

Sixteenth Day of January, 2007

JON W. DUDAS
*Director of the United States Patent and Trademark Office*